US010988331B2

(12) United States Patent
Osaki

(10) Patent No.: US 10,988,331 B2
(45) Date of Patent: Apr. 27, 2021

(54) MEDIUM CONTAINING DEVICE AND IMAGE FORMING APPARATUS

(71) Applicant: Oki Data Corporation, Tokyo (JP)

(72) Inventor: Koji Osaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 123 days.

(21) Appl. No.: 16/544,255

(22) Filed: Aug. 19, 2019

(65) Prior Publication Data

US 2020/0095077 A1 Mar. 26, 2020

(30) Foreign Application Priority Data

Sep. 26, 2018 (JP) ..... JP2018-179761

(51) Int. Cl.

*B65H 1/26* (2006.01)
*G03G 15/00* (2006.01)
*B65H 1/04* (2006.01)

(52) U.S. Cl.

CPC ..... *B65H 1/04* (2013.01); *B65H 1/266* (2013.01); *G03G 15/6502* (2013.01); *B65H 2404/74* (2013.01); *B65H 2405/1122* (2013.01); *B65H 2405/31* (2013.01); *B65H 2405/324* (2013.01); *B65H 2511/15* (2013.01); *G03G 2215/004* (2013.01)

(58) Field of Classification Search

CPC ..... B65H 1/266; B65H 2405/1122; B65H 2405/324; B65H 2405/31; B65H 2511/15; B65H 2404/74; G03G 15/6502

See application file for complete search history.

(56) References Cited

U.S. PATENT DOCUMENTS 10,745,222 B2 * 8/2020 Fuse ..... B65H 7/02
2004/0070138 A1 4/2004 Ishikuro
2016/0282786 A1 * 9/2016 Toshiyuki ..... G03G 15/6529

FOREIGN PATENT DOCUMENTS

JP 2004-106973 A 4/2004

* cited by examiner

*Primary Examiner* — Patrick Cicchino
(74) *Attorney, Agent, or Firm* — Muncy, Geissler, Olds & Lowe, P.C.

(57) ABSTRACT

A medium containing device includes a supporting member composed with a first part, a second part and a third part connecting the first part and the second part wherein the supporting member is configured to cause the first part to incline by being lifted up from a standard position, and supports recording media. When the supporting member is in the standard position, a first height position of an upper face of a first base part in a region adjacent to the first part is lower than a second height position of an upper face of the first part in a region adjacent to the first base part, and a third height position of an upper face of the second part in a region adjacent to the first base part is lower than a fourth height position of an upper face of the first base part in a region adjacent to the second part.

8 Claims, 10 Drawing Sheets

MEDIUM CONTAINING DEVICE AND IMAGE FORMING APPARATUS

TECHNICAL FIELD

This invention relates to a medium containing device that contains recording media, and an image forming apparatus provided with such a medium containing device.

BACKGROUND

In an image forming apparatus, recording media are set in a medium containing device, and images are formed on the recording media carried from this medium containing device. For example, disclosed in Patent Document 1 is a sheet feeding cassette provided with a sheet receive that supports recording media.

RELATED ART

[Patent Doc. 1] JP Laid-Open Patent Application Publication 2004-106973

By the way, in a medium containing device, it is desired that setting recording media is easy, and it is expected that setting recording media is facilitated.

It is desired to offer a medium containing device and an image forming apparatus that can facilitate setting recording media.

A medium containing device, disclosed in the application, includes a supporting member that is composed with a first part, a second part extending in a first direction and arranged in a second direction intersecting with the first direction, and a third part connecting the first part and the second part with each other, wherein the supporting member is configured to cause the first part to incline by being lifted up from a standard position, and supports recording media, and a first guiding member that has a first base part including a part installed between the first part and the second part, and a first erected part erected on the first base part, and guides the recording media, wherein when the supporting member is in the standard position, a first height position of an upper face of the first base part in a region adjacent to the first part is lower than a second height position of an upper face of the first part in a region adjacent to the first base part, and a third height position of an upper face of the second part in a region adjacent to the first base part is lower than a fourth height position of an upper face of the first base part in a region adjacent to the second part.

Another image forming apparatus, disclosed in the application, includes a medium containing part that contains recording media, a carrying part that carries the recording media contained in the medium containing part, and image forming parts that form images on the recording media carried by the carrying part, wherein the medium containing part has a supporting member that is composed with a first part, a second part extending in a first direction and arranged in a second direction intersecting with the first direction, and a third part connecting the first part and the second part with each other, wherein the supporting member is configured to cause the first part to incline by being lifted up from a standard position, and supports recording media, and a first guiding member that has a first base part including a part installed between the first part and the second part, and a first erected part erected on the first base part, and guides the recording media, and when the supporting member is in the standard position, a first height position of an upper face of the first base part in a region adjacent to the first part is lower than a second height position of an upper face of the first part in a region adjacent to the first base part, and a third height position of an upper face of the second part in a region adjacent to the first base part is lower than a fourth height position of an upper face of the first base part in a region adjacent to the second part.

According to the medium containing device and the image forming apparatus in an embodiment of this invention, when the supporting member is in the standard position, the first height position of the upper face of the first base part in the region adjacent to the first part is set lower than the second height position of the upper face of the first part in the region adjacent to the first base part, and the third height position of the upper face of the second part in the region adjacent to the first base part is set lower than the fourth height position of the upper face of the first base part in the region adjacent to the second part, thereby setting recording media can be facilitated.

DETAILED DESCRIPTION OF THE PREFERRED EMBODIMENT(S)

Below, embodiments of this invention are explained in detail referring to drawings. Note that the explanations are given in the following order.

1. First Embodiment
2. Second Embodiment

1. First Embodiment

[Configuration Example]

Figure 1:
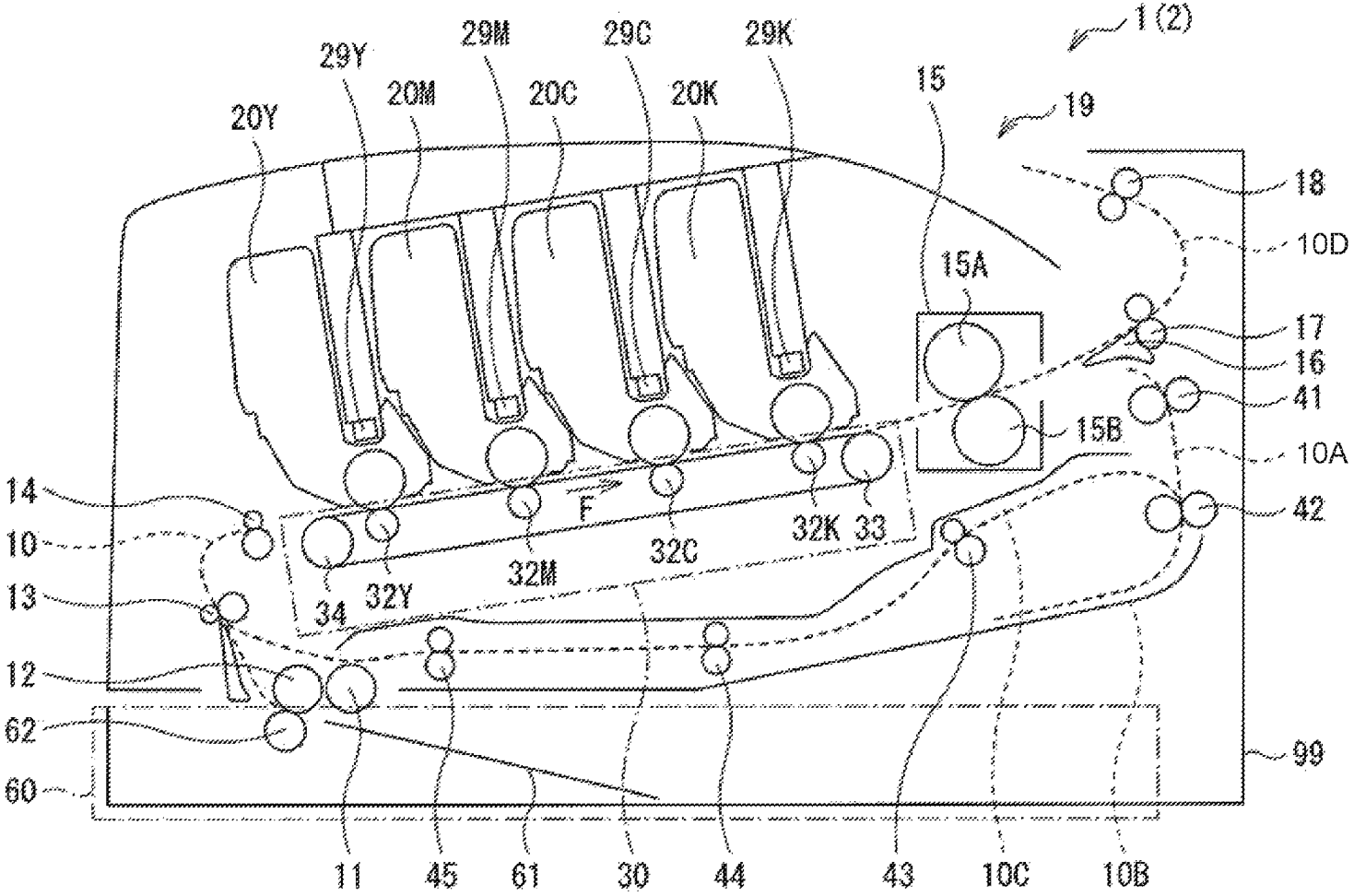
FIG. 1 is a configuration diagram showing a configuration example of an image forming apparatus of an embodiment.

FIG. 1 shows a configuration example of an image forming apparatus (image forming apparatus 1) provided with the medium containing device of an embodiment of this invention. The image forming apparatus 1 is, for example, a printer that forms images using an electrophotographic system on recording media made of normal paper, etc. The image forming apparatus 1 is provided with a medium containing part 60, a carrying roller 11, a medium supply roller 12, a registration roller 13, a carrying roller 14, four image forming parts 20 (image forming parts 20Y, 20M, 20C, and 20K), four exposure heads 29 (exposure heads 29Y, 29M, 29C, and 29K), a transfer part 30, a fuser part 15, a separator 16, carrying rollers 41-45, and ejection rollers 17 and 18. These members are disposed along a carrying route where recording media 9 are carried.

The medium containing part 60 is configured so as to contain recording media 9 where images are to be formed. The medium containing part 60 is configured so as to be slide-inserted to a chassis 99 of the image forming apparatus 1 from the left side of FIG. 1. The medium containing part 60 has a sheet receive 61 and a separation roller 62. The sheet receive 61 is configured so that it can stack the recording media 9 contained in the medium containing part 60 and be inclined at an angle according to the stacked amount of the recording media 9. When the medium containing part 60 is extracted from the chassis 99 of the image forming apparatus 1, the sheet receive 61 is fixed in an almost flat state with no inclination (a standard position). Also, when the medium containing part 60 is inserted to the chassis 99 of the image forming apparatus 1, the sheet receive 61 is driven by an unshown motor to be inclined. The separation roller 62 is configured so as to form a pair with the medium supply roller 12 across the carrying route 10.

The carrying roller 11 is configured so as to carry the recording media 9 contained in the medium containing part 60 toward the separation roller 62 and the medium supply roller 12.

The medium supply roller 12 is configured so as to form a pair with the separation roller 62 across the carrying route 10, extract the recording media 9 contained in the medium containing part 60 from the uppermost part by one sheet at a time, and forward the extracted recording medium 9 to the carrying route 10.

The registration roller 13 is a pair of rollers across the carrying route 10, and is configured so as to correct skew of the recording media 9 carried from the separation roller 62 and the medium supply roller 12 and carry the recording media 9 along the carrying route 10.

The carrying roller 14 is a pair of rollers across the carrying route 10, and is configured so as to carry the recording media 9 supplied from the registration roller 13 along the carrying route 10.

The four image forming parts 20 are configured so as to form toner images. Specifically, the image forming part 20Y forms yellow (Y) toner images, the image forming part 20M forms magenta (M) toner images, the image forming part 20C forms cyan (C) toner images, and the image forming part 20K forms black (K) toner images. In this example, the four image forming parts 20 are disposed in the order of the image forming parts 20Y, 20M, 20C, and 20K along the carrying direction F of the recording media 9. The image forming parts 20 are configured so as to be detachable from the image forming apparatus 1.

Figure 2:
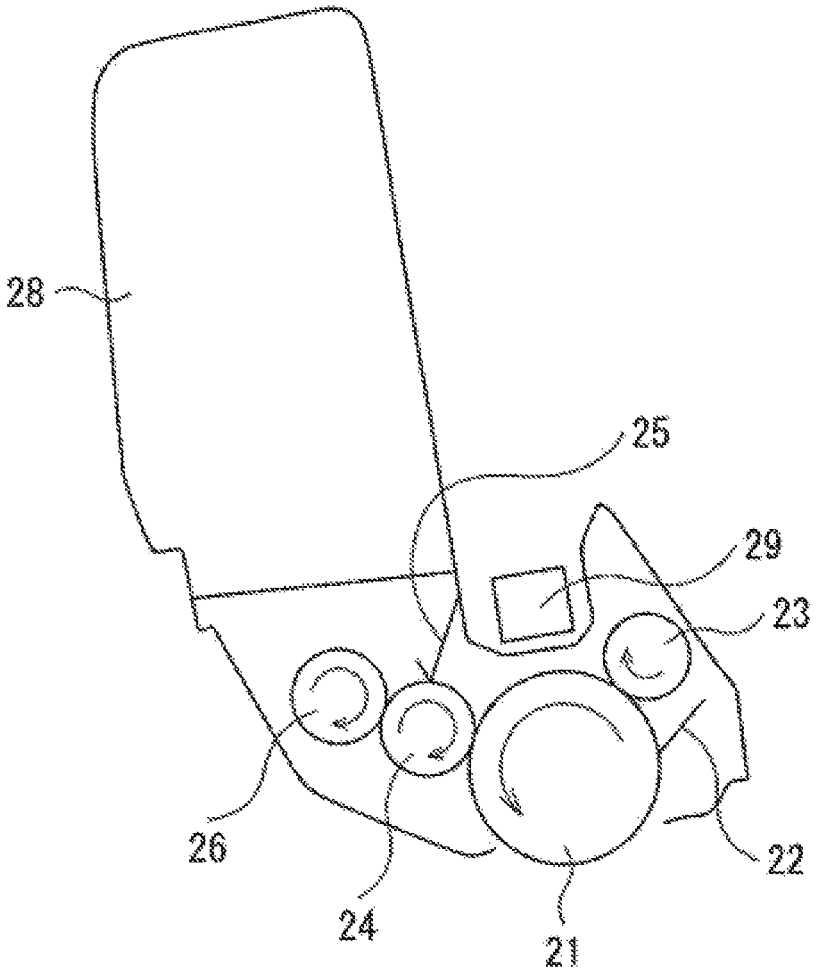
FIG. 2 is a configuration diagram showing a configuration example of an image forming part shown in FIG. 1.

FIG. 2 shows a configuration example of each of the image forming parts 20. Note that in FIG. 2 one of the exposure heads 29 is also shown. The image forming part 20 has a toner accommodating part 28, a photosensitive drum 21, a cleaning blade 22, a charging roller 23, a development roller 24, a development blade 25, and a supply roller 26.

The toner accommodating part 28 is configured so as to accommodate toner. Specifically, the toner accommodating part 28 of the image forming part 20Y accommodates yellow toner, the toner accommodating part 28 of the image forming part 20M accommodates magenta toner, the toner accommodating part 28 of the image forming part 20C accommodates cyan toner, and the toner accommodating part 28 of the image forming part 20K accommodates black toner.

The photosensitive drum 21 is configured so as to carry an electrostatic latent image on its surface (surface layer part). The photosensitive drum 21 rotates anticlockwise in this example by a power transmitted from an unshown drum motor. The photosensitive drum 21 is charged by the charging roller 23 and exposed by the exposure head 29. Specifically, the photosensitive drum 21 of the image forming part 20Y is exposed by the exposure head 29Y, the photosensitive drum 21 of the image forming part 20M is exposed by the exposure head 29M, the photosensitive drum 21 of the image forming part 20C is exposed by the exposure head 29C, and the photosensitive drum 21 of the image forming part 20K is exposed by the exposure head 29K. Thereby, an electrostatic latent image is formed on the surface of the photosensitive drums 21. Then, by toner being supplied by the development roller 24 to the photosensitive drum 21, a toner image according to the electrostatic latent image is formed.

The cleaning blade 22 is configured so as to perform cleaning by scraping off toner remaining on the surface (surface layer part) of the photosensitive drum 21.

The charging roller 23 is configured so as to charge the surface (surface layer part) of the photosensitive drum 21. The charging roller 23 is disposed so as to be in contact with the surface (circumferential face) of the photosensitive drum 21 and pressed against the photosensitive drum 21 with a prescribed amount of pressing force. The charging roller 23 rotates clockwise in this example according to the rotation of the photosensitive drum 21. Applied to the charging roller 23 is a charging voltage by an image formation control part 56 (mentioned below).

The development roller 24 is configured so as to carry toner on its surface. The development roller 24 is disposed so as to be in contact with the surface (circumferential face) of the photosensitive drum 21 and pressed against the photosensitive drum 21 with a prescribed amount of pressing force. The development roller 24 rotates clockwise in this example by a power transmitted from the unshown drum motor. Applied to the development roller 24 is a development voltage by the image formation control part 56 (mentioned below).

The development blade 25 is configured so as to contact with the surface of the development roller 24, thereby forming a layer made of toner (toner layer) on the surface of this development roller 24 and regulating (controlling, adjusting) the thickness of the toner layer. The development blade 25 is, for example, a plate-shaped elastic member made of stainless steel that is bent in an L shape. The development blade 25 is disposed so that its bent part is in contact with the surface of the development roller 24 and pressed against the development roller 24 with a prescribed amount of pressing force.

The supply roller 26 is configured so as to supply toner supplied from the toner containing part 28 to the development roller 24. The supply roller 26 is disposed so as to be in contact with the surface (circumferential face) of the development roller 24 and pressed against the development roller 24 with a prescribed amount of pressing force. The supply roller 26 rotates clockwise in this example by a power transmitted from the unshown drum motor. Thereby, in each of the image forming parts 20, friction occurs between the surface of the supply roller 26 and the surface of the development roller 24. As a result, in each of the image forming parts 20, toner is charged by so-called frictional charging. Applied to the supply roller 26 is a supply voltage by the image formation control part 56 (mentioned below).

The four exposure heads 29 (FIG. 1) are configured so as to radiate light onto the respective photosensitive drums 21 of the corresponding image forming parts 20. Specifically, the exposure head 29Y radiates light onto the photosensitive drum 21 of the image forming part 20Y, the exposure head 29M radiates light onto the photosensitive drum 21 of the image forming part 20M, the exposure head 29C radiates light onto the photosensitive drum 21 of the image forming part 20C, and the exposure head 29K radiates light onto the photosensitive drum 21 of the image forming part 20K. Each of the exposure heads 29 has multiple light emitting diodes arranged in the main scanning direction (the depth direction in FIG. 1) for example, and radiates light in dots onto the corresponding photosensitive drum 21 using these light emitting diodes. Thereby, these photosensitive drums 21 are exposed by the corresponding exposure heads 29, forming an electrostatic latent image on the surface of each of the photosensitive drums 21.

The transfer part 30 is configured so as to transfer the toner images formed by the four image forming parts 20 onto a transfer target surface of the recording medium 9. The transfer part 30 has a transfer belt 31, four transfer rollers 32 (32Y, 32M, 32C, and 32K), a drive roller 33, and a driven roller 34.

The transfer belt 31 is configured so as to carry the recording medium 9 along the carrying route 10 in the carrying direction F. The transfer belt 31 is stretched by the drive roller 33 and the driven roller 34. Then, the transfer belt 31 is circularly carried in the carrying direction F according to the rotation of the drive roller 33.

The transfer roller 32Y is disposed opposing the photosensitive drum 21 of the image forming part 20Y across the carrying route 10 and the transfer belt 31, the transfer roller 32M is disposed opposing the photosensitive drum 21 of the image forming part 20M across the carrying route 10 and the transfer belt 31, the transfer roller 32C is disposed opposing the photosensitive drum 21 of the image forming part 20C across the carrying route 10 and the transfer belt 31, and the transfer roller 32K is disposed opposing the photosensitive drum 21 of the image forming part 20K across the carrying route 10 and the transfer belt 31. Applied to each of the transfer rollers 32Y, 32M, 32C, and 32K is a transfer voltage by the image formation control part 56 (mentioned below). Thereby, in the image forming apparatus 1, the toner images formed in the image forming parts 20 are transferred onto the transfer target surface of the recording medium 9.

The drive roller 33 is configured so as to stretch the transfer belt 31 together with the driven roller 34 and circularly carry this transfer belt 31. In this example, the drive roller 33 is disposed in the downstream side of the four image forming parts 20 in the carrying direction F. The drive roller 33 rotates clockwise in this example by a power transmitted from an unshown belt motor.

The driven roller 34 is configured so as to stretch the transfer belt 31 together with the drive roller 33 and be rotated according to the circular carriage of the transfer belt 31. In this example, the driven roller 34 is disposed in the upstream side of the four image forming parts 20 in the carrying direction F.

The fuser part 15 is configured so as to have the toner image transferred onto a recording medium 9 fused with the recording medium 9 by applying heat and a pressure to the recording medium 9. The fuser part 15 has a heat roller 15A and a pressure application roller 15B. The heat roller 15A is configured so as to give heat to the toner on the recording medium 9. The heat roller 15A is configured including a heater such as a halogen heater. The heat roller 15A rotates anticlockwise in this example by a power transmitted from an unshown heater motor. The pressure application roller 15B is configured so as to be pressed against the heat roller 15A with a prescribed amount of pressing force. Thereby, in the fuser part 15, a nip part is formed between the heat roller 15A and the pressure application roller 15B, and in this nip part the toner on the recording medium 9 is heated, melted, and pressed. As a result, the toner image is fused onto the recording medium 9.

The separator 16 is configured so as to switch the carrying route 10 that should carry a recording medium 9 supplied from the fuser part 15 to one of a carrying route 10 returning to the registration roller 13 (a carrying route 10A, a retreat carrying route 10B, and a carrying route 10C) and a carrying route 10 guiding to an ejection tray 19 (a carrying route 10D). Note that in FIG. 1 the separator 16 guides recording media 9 to the carrying route 10D. The carrying route 10 returning the recording medium 9 to the registration roller 13 is selected when forming images on both sides of the recording medium 9, namely performing a so-called double-side printing.

The carrying roller 41 is a pair of rollers across the carrying route 10A disposed in the downstream side of the separator 16 in the carrying route 10A, and is configured so as to carry a recording medium 9 guided to the carrying route 10A by the separator 16 along the carrying route 10A.

The carrying roller 42 is a pair of rollers, and is configured so as to carry a recording medium 9 carried by the carrying roller 41 along the carrying route 10A to the retreat carrying route 10B, afterwards reverse the carrying direction of the recording medium 9, and carry the recording medium 9 retreated to the retreat carrying route 10B along the carrying route 10C.

The carrying roller 43 is a pair or rollers across the carrying route 10C, the carrying roller 44 is a pair of rollers across the carrying route 10C, and the carrying roller 45 is a pair or rollers across the carrying route 10C. The carrying rollers 43-45 are configured so as to carry a recording medium 9 along the carrying route 10C toward the registration roller 13.

The ejection roller 17 is a pair or rollers across the carrying route 10D disposed in the downstream side of the separator 16 in the carrying route 10D, and is configured so as to carry a recording medium 9 guided to the carrying route 10D by the separator 16 along the carrying route 10D.

The ejection roller 18 is a pair or rollers across the carrying route 10D, and is configured so as to carry a recording medium 9 carried by the ejection roller 17 toward the ejection tray 19.

Figure 3:
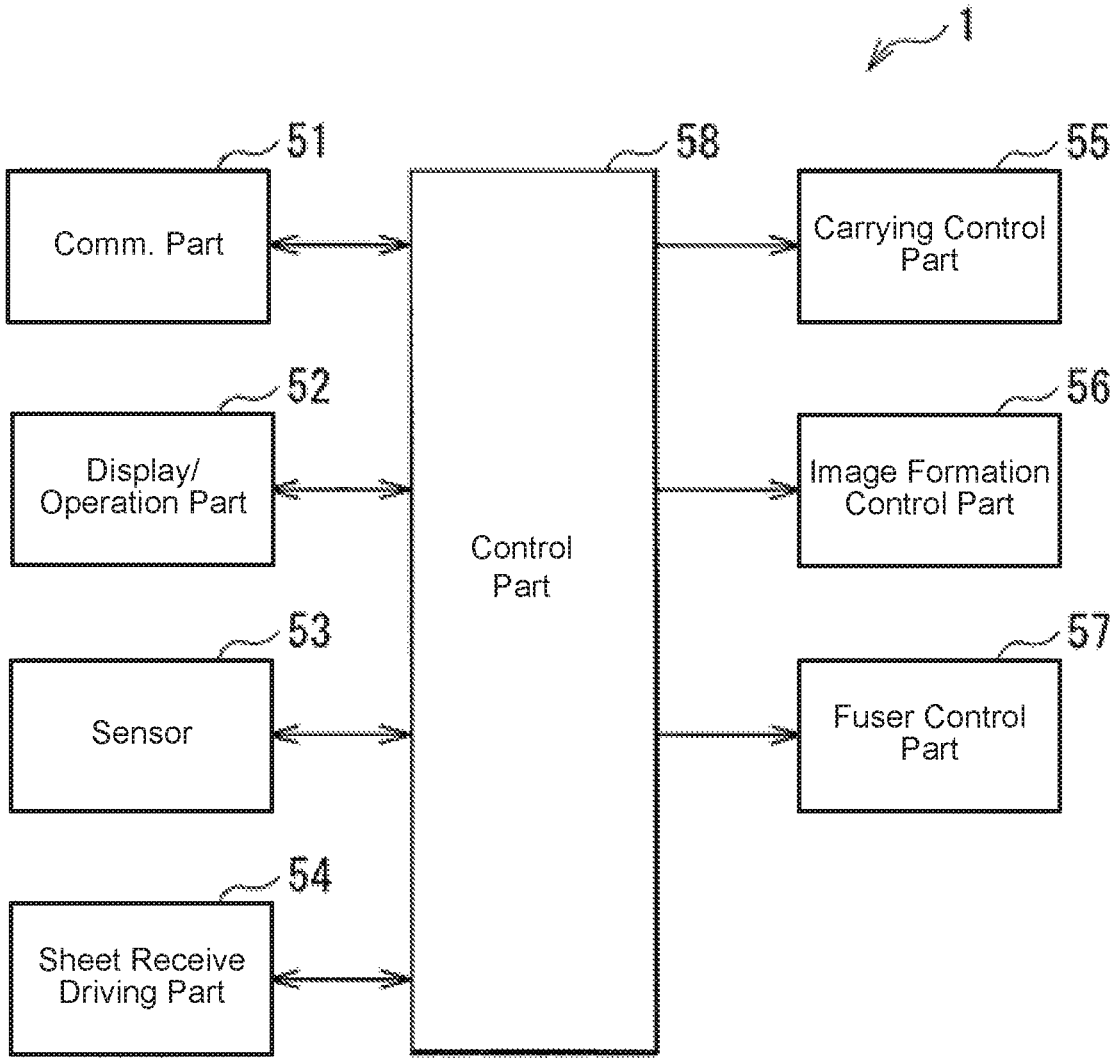
FIG. 3 is a block diagram showing an example of the control system of the image forming apparatus of an embodiment.

FIG. 3 shows an example of the control system of the image forming apparatus 1. The image forming apparatus 1 is provided with a communication part 51, a display/operation part 52, a sensor 53, a sheet receive driving part 54, a carrying control part 55, an image formation control part 56, a fuser control part 57, and a control part 58.

The communication part 51 is configured so as to perform communication using a USB (Universal Serial Bus) or LAN (Local Area Network) for example. The communication part 51 is configured so as to receive print data DP sent from a host computer (not shown) for example.

The display/operation part 52 is configured so as to receive a user's operations and display the operation state of the image forming apparatus 1, instructions to the user, etc. The display/operation part 52 is configured of a touch panel, various buttons, a liquid crystal display, various indicators, etc. for example.

The sensor 53 is configured so as to detect that the medium containing part 60 is inserted to the image forming apparatus 1.

The sheet receive driving part 54 includes a motor for example, and is configured so as to operate this motor according to instructions from the control part 58 when the medium containing part 60 is inserted to the image forming apparatus 1, thereby inclining the sheet receive 61 until the uppermost part of a bunch of recording media 9 on the sheet receive 61 comes into contact with the carrying roller 11 (FIG. 1). Therefore, the sheet receive 61 is inclined at an angle according to the stacked amount of recording media 9 in the medium containing part 60.

The carrying control part 55 is configured so as to control the operations of various motors and the separator 16 related to the carrying operation of recording media 9 according to instructions from the control part 58, thereby carrying the recording media 9 along the carrying route 10.

The image formation control part 56 is configured so as to control image forming operations in the four image forming parts 20, the four exposure heads 29, and the transfer part 30 according to instructions from the control part 58, thereby forming images on recording media 9. Specifically, the image formation control part 56 generates the charging voltage, the development voltage, the supply voltage, and the transfer voltage used in the four image forming parts 20 and the transfer part 30. Also, the image formation control part 56 controls the operations of the drum motor and the belt motor that are unshown, thereby controlling the operations of various rollers in the four image forming parts 20 and the transfer part 30. Also, the image formation control part 56 controls the exposure operations in the four exposure heads 29 based on images to be formed.

The fuser control part 57 is configured so as to control the fusing operation in the fuser part 15 according to instructions from the control part 58. Specifically, the fuser control part 57 controls the operation of the heater (not shown) inside the heat roller 15A, thereby controlling temperature in the fuser part 15. Also, the fuser control part 57 controls the operation of the unshown heater motor, thereby controlling the carrying operation of the recording medium 9 in the fuser part 15.

The control part 58 controls the operations of individual blocks inside the image forming apparatus 1, thereby controlling the whole operation of the image forming apparatus 1. The control part 58 is configured, for example, using a processor that can execute programs, RAM (Random Access Memory), ROM (Read Only Memory) that stores the programs, etc.

(Medium Containing Part 60)

Figure 4:
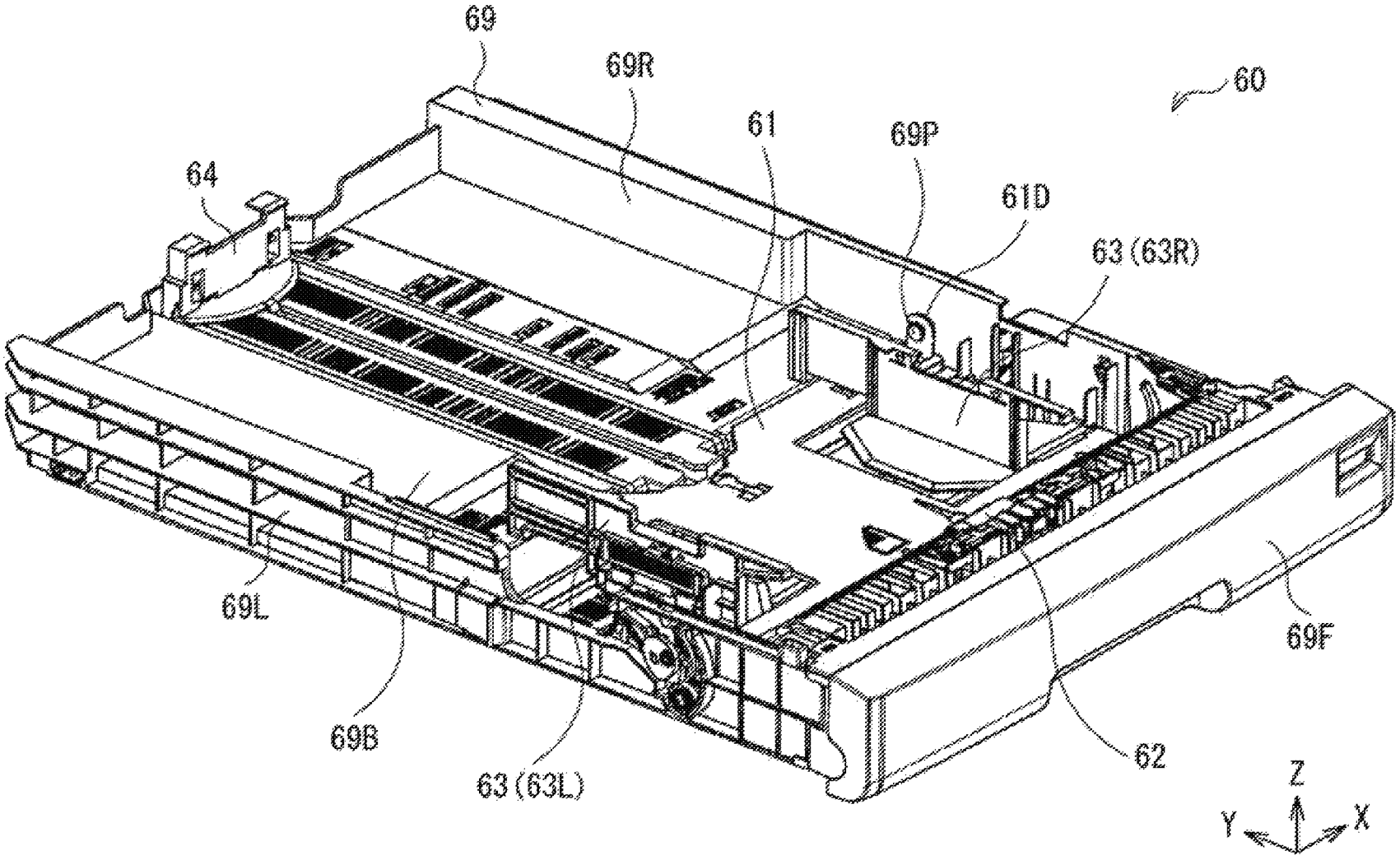
FIG. 4 is a perspective view showing a configuration example of a medium containing part of the first embodiment.
Figure 5:
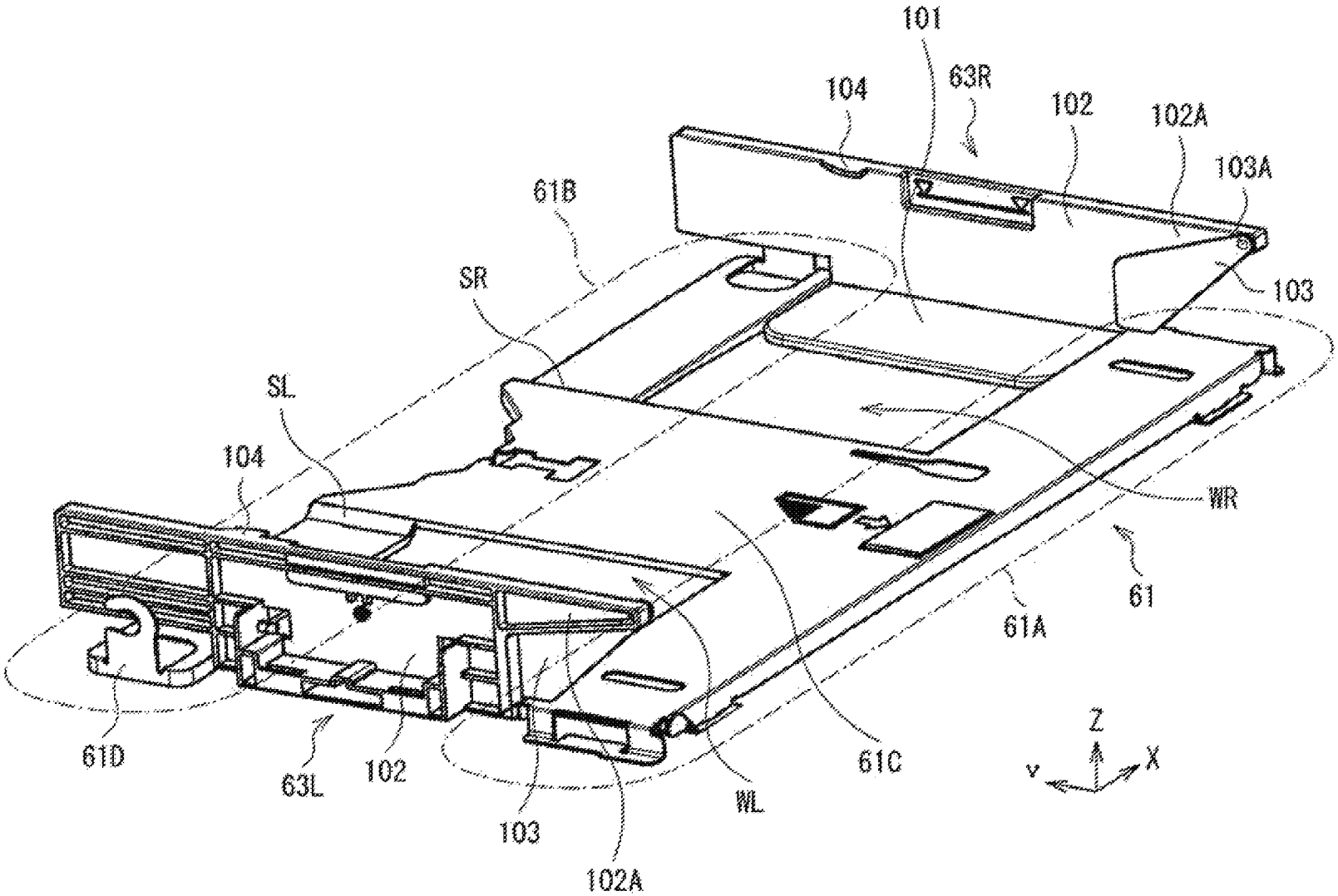
FIG. 5 is a perspective view showing a configuration example of a sheet receive and a medium guide shown in FIG. 4.

FIG. 4 shows a configuration example of the medium containing part 60. The medium containing part 60 has a case 69, two medium guides 63 (medium guides 63L and 63R), and a tail guide 64. FIG. 5 shows a configuration example of the sheet receive 61 and the two medium guides 63.

The case 69 (FIG. 4) is configured so as to contain recording media 9. The case 69 has a front face part 69F, a left-side face part 69L, a right-side face part 69R, and a bottom part 69B. The medium containing part 60 is configured so as to be inserted to the chassis 99 of the image forming apparatus 1 by the user pressing the front face part 69F and sliding it in the Y direction. Installed on the upper part of the front face part 69F is the separation roller 62. Also, installed on the bottom part 69B are the sheet receive 61, the two medium guides 63, and the tail guide 64.

The sheet receive 61 (FIG. 5) has stacking parts 61A-61C and two hook-shaped parts 61D. The stacking parts 61A and 61B are formed so as to extend in the X direction and be arranged in the Y direction. The stacking part 61C connects the vicinity of the center in the X direction of the stacking part 61A and the vicinity of the center in the X direction of the stacking part 61B with each other. In other words, in the sheet receive 61, a region between the stacking part 61A and the stacking part 61B except in the vicinity of the X-direction center is cut out, forming cut-out sections WL and WR. Also, the stacking part 61B has steps SL and SR installed near the stacking part 61C. In this example, the steps SL and SR are formed so as to extend in the Y direction. Other than these steps SL and SR, the upper faces of the stacking parts 61A-61C are formed so as to be approximately flat. Thereby, the height position of the upper face of the part adjacent to the cut-out section WL in the stacking part 61B is formed lower than the height position of the upper face of the part adjacent to this cut-out section WL in the stacking part 61A. In the same manner, the height position of the upper face of the region (61R) adjacent to the cut-out section WR in the stacking part 61B is formed lower than the height position of the upper face of the region (61S) adjacent to this cut-out section WR in the stacking part 61A. The two hook-shaped parts 61D are formed at both ends in the X direction of the stacking part 61B. As shown in FIG. 4, the two hook-shaped parts 61D are each rotatably connected to protruding parts 69P installed on the inner sides of the left-side face part 69L and the right-side face part 69R. That is, the sheet receive 61 can rotate with this protruding part 69P as the rotational fulcrum. Thereby, driven by the sheet receive driving part 54, the sheet receive 61 can be inclined so that the stacking part 61A is lifted up from the standard position. In the embodiment, the stacking parts 61A and 61B extends in parallel between the lateral sides (X-direction). The stacking parts 61A-61C are integrally formed from a single metal plate, and ascend/desend together.

The two medium guides 63 (FIG. 5) are configured so as to contact with the side faces of a bunch of recording media 9 in the width direction (X direction) of the recording media 9, thereby guiding the recording media 9. The medium guides 63L and 63R are disposed so as to oppose each other across the stacking part 61C of the sheet receive 61. That is, the medium guide 63L is disposed in the cut-out section WL of the sheet receive 61, and the medium guide 63R is disposed in the cut-out section WR of the sheet receive 61. The medium guides 63L and 63R are configured movable in the X direction on the bottom part 69B of the case 69. Specifically, the medium guides 63L and 63R can move by the same amount of movement in mutually different directions in the X direction. Thereby, in the medium containing part 60, recording media 9 of various sizes can be set, and the center position in the width direction of the set recording media 9 can be maintained independently of the size of the recording media 9.

Each of the two medium guides 63 has a base part 101, guiding parts 102 and 103, and a protruding part 104.

The base part 101 is configured so as to support the guiding part 102. When the two medium guides 63 are moved in the X direction to narrow the space between the two medium guides 63, the base parts 101 of the two medium guides 63 fit under the stacking part 61C. Thereby, the medium guides 63 can guide narrow recording media 9.

Figure 6:
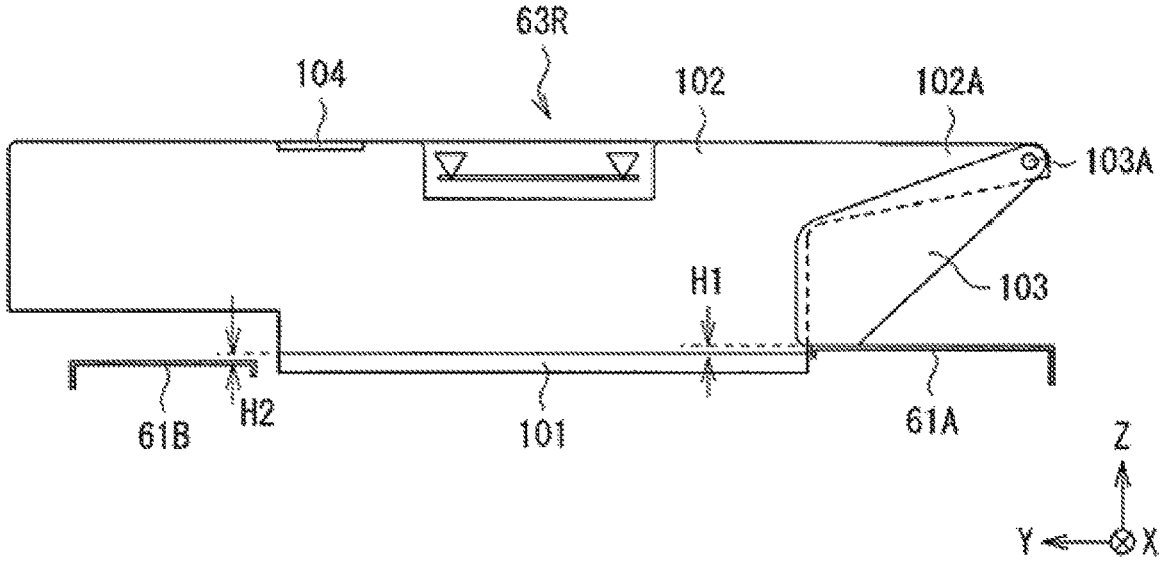
FIG. 6 is an explanatory diagram showing the positional relation between the sheet receive and the medium guide shown in FIG. 4.

FIG. 6 shows the positional relation between the medium guide 63R and the stacking parts 61A and 61B of the sheet receive 61 when the sheet receive 61 is in the standard position. As shown in this FIG. 6, the height position of the upper face of the base part 101 in the region (101P) adjacent to the stacking part 61A is lower than the height position of the upper face of the stacking part 61A in the region (61P) adjacent to the base part 101 by height H1. Also, the height position of the upper face of the stacking part 61B in the region (61Q) adjacent to the base part 101 is lower than the height position of the upper face of the base part 101 in the region (101Q) adjacent to the stacking part 61B by height H2. Note that although the positional relation between the medium guide 63R and the stacking parts 61A and 61B was described in FIG. 6, the same applies to the positional relation between the medium guide 63L and the stacking parts 61A and 61B. Thereby, in the image forming apparatus 1, as mentioned below, when the user sets recording media 9 into the medium containing part 60, setting the recording media 9 can be facilitated.

The guiding part 102 is configured so as to be erected on the base part 101 in a part away from the stacking part 61C of the base part 101. The guiding part 102 is configured so as to be in contact with the side face of a bunch of recording media 9. The side face is determined with respect to the X direction. The guiding part 102 is configured so as to have an extension part 102A extending in the Y direction above the stacking part 61A. In other words, in the guiding part 102, the lower vicinity of the extension part 102A is cut out in order to prevent the guiding part 102 from interfering with the stacking part 61A when the sheet receive 61 is inclined. In this embodiment, a pair of the guiding part 102 is arranged, each of which faces in X-direction.

The guiding part 103 is disposed near the stacking part 61A of the sheet receive 61 on the guiding part 102. This guiding part 103 is configured rotatable centering on the rotational fulcrum 103A installed on the extension part 102A of the guiding part 102. When the sheet receive 61 is in the standard position, as shown in FIG. 6, the guiding part 103 rotates by its own weight, and the lower edge 103*le* of the guiding part 103 contacts with the stacking part 61A of the sheet receive 61, thus covering the cut-out section below the extension part 102A of the guiding part 102. Thereby, as mentioned below, the image forming apparatus 1 is designed so that when the user sets recording media 9 in the medium containing part 60, setting the recording media 9 can be facilitated. The cut-out section is indicated with a light hatching in FIG. 6. In this embodiment, a pair of the guiding part 103 is arranged, each of which faces in X-direction and disposed inside the guiding parts 102.

Note that although the cut-out section of the guiding part 102 is covered using one piece of plate in this example, this invention is not limited to this, but multiple pieces of plates can be stacked, and these multiple pieces of plates can be each shifted slightly centering on the rotational fulcrum 103A to cover the cut-out section of the guiding part 102.

The protruding part 104 of the medium guide 63L is installed protruding toward the medium guide 63R on the upper part of the guiding part 102, and the protruding part 104 of the medium guide 63R is installed protruding toward the medium guide 63L on the upper part of the guiding part 102. The protruding parts 104 are installed so as to prevent the recording media 9 stacked on the sheet receive 61 from rising up when carrying a recording medium 9 from the medium containing part 60. These protruding parts 104 are disposed in a position higher than the height corresponding to the maximum stacked amount of recording media 9 in the medium containing part 60.

The tail guide 64 is configured so as to contact with the side face of a bunch of recording media 9 in the length direction (Y direction) of the recording media 9, thereby guiding the recording media 9. The tail guide 64 is configured movable in the Y direction on the bottom part 69B of the case 69. Thereby, recording media 9 of various sizes can be set in the medium containing part 60.

Here, the sheet receive 61 corresponds to a specific example of the "supporting member" in this invention. The stacking part 61A corresponds to a specific example of the "first part" in this invention, the stacking part 61B corresponds to a specific example of the "second part" in this invention, and the stacking part 61C corresponds to a specific example of the "third part" in this invention. The two medium guides 63 correspond to specific examples of the "first guiding member" and the "second guiding member" in this invention. The base parts 101 of the two medium guides 63 correspond to specific examples of the "first base part" and the "second base part" in this invention. The guiding parts 102 of the two medium guides 63 correspond to specific examples of the "first erected part" and the "second erected part" in this invention. The guiding part 103 corresponds to a specific example of the "rotating part" in this invention. The case 69 corresponds to a specific example of the "medium case" in this invention. The sheet receive driving part 54 corresponds to a specific example of the "lifting part" in this invention. The medium containing part 60 corresponds to a specific example of the "medium containing part" in this invention. The carrying roller 11, the separation roller 62, the medium supply roller 12, the registration roller 13, and the carrying roller 14 correspond to a specific example of the "carrying part" in this invention. The image forming parts 20 correspond to a specific example of the "image forming part" in this invention.

[Operations and Actions]

Next, the operations and actions of the image forming apparatus 1 of this invention are explained.

(Overall Operation Outline)

First, the overall operation outline of the image forming apparatus 1 is explained referring to FIGS. 1 and 3. Once the communication part 51 has received print data DP sent from the host computer (not shown), the control part 58 controls the operation of each block so that the image forming apparatus 1 performs an image forming operation. Thereby, the image forming operation is started.

The carrying roller 11, the medium supply roller 12, and the separation roller 62 extract recording media 9 contained in the medium containing part 60 from the uppermost part by one sheet at a time, and forwards the extracted recording medium 9 to the carrying route 10. The registration roller 13 corrects skew of the recording medium 9, and also carries the recording medium 9 along the carrying route 10. Thereby, the recording medium 9 is carried to the four image forming parts 20.

In each of the four image forming parts 20, the surface of the photosensitive drum 21 is negatively charged by the charging roller 23. Then, by the photosensitive drum 21 being exposed by the exposure head 29, an electrostatic latent image is formed on the surface of the photosensitive drum 21. Then, by toner being supplied by the development roller 24 to the photosensitive drum 21, a toner image according to the electrostatic latent image is formed on the photosensitive drum 21. The transfer part 30 transfers the toner images formed on the four image forming parts 20 onto the transfer target surface of the recording medium 9. Then, in the fuser part 15, the toner on the recording medium 9 is heated, melted, and pressed. As a result, the toner image is fused onto the recording medium 9.

Then, the separator 16 guides the recording medium 9 supplied from the fuser part 15 to the carrying route 10D in this example. The ejection rollers 17 and 18 carry the recording medium 9 along the carrying route 10D. Thereby, the recording medium 9 is ejected to the ejection tray 19.

(Detailed Operations)

In the image forming apparatus 1, the user extracts the medium containing part 60 from the chassis 99 of the image forming apparatus 1, and sets recording media 9 in the medium containing part 60. At that time, if the medium containing part 60 can be fully extracted from the chassis 99, the user can set a bunch of the recording media 9 from right above the extracted medium containing part 60. However, if the installation space for the image forming apparatus 1 cannot be sufficiently secured, because the user cannot fully extract the medium containing part 60 from the chassis 99, he extracts the medium containing part 60 midway and sets the recording media 9 into the midway extracted medium containing part 60. Even in such a case, the image forming apparatus 1 can make it easy for the user to set the recording media 9 into the medium containing part 60. Below, this technology is explained in detail.

Figure 7:
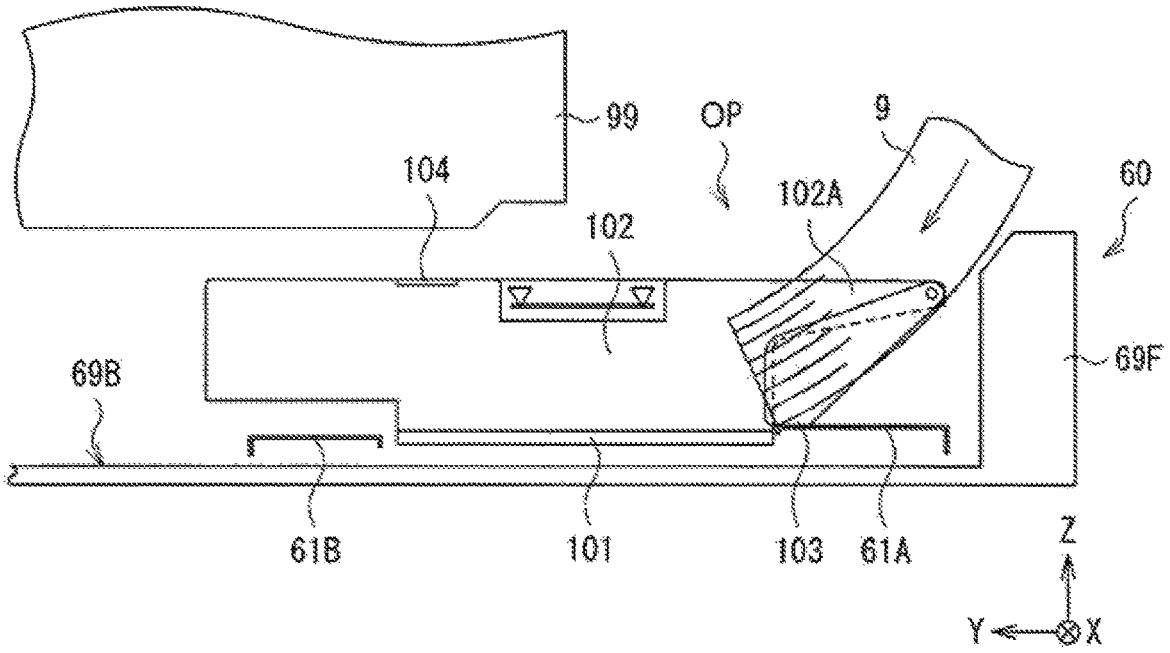
FIG. 7 is an explanatory diagram showing the actions of the medium containing part of the first embodiment.
Figure 8:
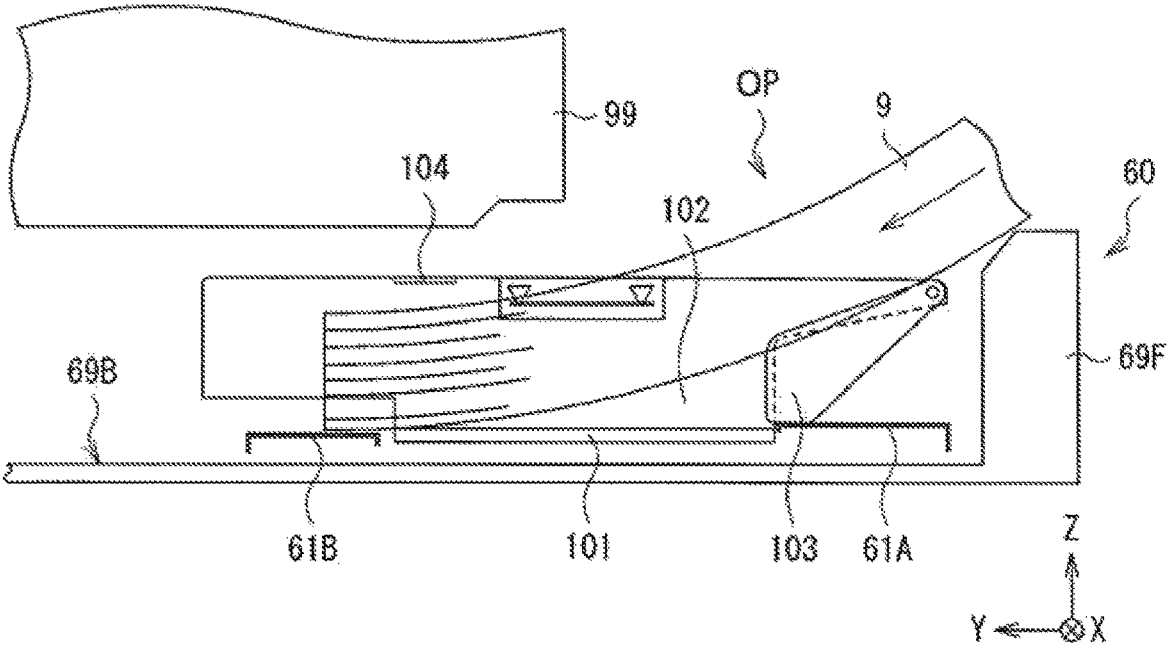
FIG. 8 is another explanatory diagram showing the actions of the medium containing part of the first embodiment.

FIGS. 7 and 8 show the states of the medium containing part 60 when the user sets recording media 9. In this example, the user has extracted the medium containing part 60 midway from the chassis 99 of the image forming apparatus 1. Specifically, in this example, the user has extracted the medium containing part 60 by about 20 cm. By extracting the medium containing part 60 in this manner, the sheet receive 61 is fixed to an almost flat state with no inclination (the standard position). For example, when setting recording media 9 of the A4 size, at this extent of extraction, the user cannot set a bunch of the recording media 9 from right above the medium containing part 60. Therefore, as shown in FIGS. 7 and 8, the user slip-inserts the bunch of recording media 9 to the medium containing part 60 from an opening part OP generated by extracting the medium containing part 60 midway, thereby setting the recording media 9 into the medium containing part 60.

Once the user has inserted the bunch of recording media 9 to the medium containing part 60, the bunch of recording media 9 is first guided by the guiding parts 103 installed in front of the guiding parts 102 in the medium guides 63L and 63R, and afterwards guided by the guiding parts 102 of the medium guides 63L and 63R. Then, the lower face of the bunch of recording media 9 is guided by the stacking parts 61A-61C of the sheet receive 61 and the base parts 101 of the medium guides 63L and 63R For example, in FIG. 7, the leading edge of the lower face of a bunch of recording media 9 has reached the vicinity of the boundary between the stacking part 61A of the sheet receive 61 and the base parts 101 of the medium guides 63L and 63R. In the image forming apparatus 1, as shown in FIG. 6, the height position of the upper faces of the base parts 101 in the region adjacent to the stacking part 61A is set lower than the height position of the upper face of the stacking part 61A in the region adjacent to the base parts 101. Thereby, in the image forming apparatus 1, as shown in FIG. 7, when the user inserts a bunch of recording media 9 to the medium containing part 60, the possibility that the leading edge of the lower face of the bunch of recording media 9 is caught in the vicinity of the boundary between the stacking part 61A and the base parts 101 can be reduced.

Also, in the image forming apparatus 1, as shown in FIG. 7, the guiding parts 103 cover the cut-out sections below the extension parts 102A of the guiding parts 102. Thereby, in the image forming apparatus 1, as shown in FIG. 7, when the user inserts a bunch of recording media 9 to the medium containing part 60, the possibility that the leading edge corner of the bunch of recording media 9 is caught by the cut-out sections of the guiding parts 102 can be reduced.

Also, for example, in FIG. 8, the leading edge of the lower face of a bunch of recording media 9 has reached the vicinity of the boundary between the base parts 101 of the medium guides 63L and 63R and the stacking part 61B of the sheet receive 61. In the image forming apparatus 1, as shown in FIG. 6, the height position of the upper face of the stacking part 61B in the region adjacent to the base parts 101 is set lower than the height position of the upper faces of the base parts 101 in the region adjacent to the stacking part 61B. Thereby, in the image forming apparatus 1, as shown in FIG. 8, when the user inserts a bunch of recording media 9 to the medium containing part 60, the possibility that the leading edge of the lower face of the bunch of recording media 9 is caught in the vicinity of the boundary between the base parts 101 and the stacking part 61B can be reduced.

Once the user has finished slip-inserting the bunch of recording media 9 to the medium containing part 60 in this manner, the user presses the front face part 69F to slide the medium containing part 60 in the Y direction, thereby inserting the medium containing part 60 to the chassis 99 of the image forming apparatus 1. Thereby, in the image forming apparatus 1, in this example, the sensor 53 detects that the medium containing part 60 is inserted to the chassis 99 of the image forming apparatus 1, and the sheet receive driving part 54 operates an unshown motor to incline the sheet receive 61 from the standard position until the uppermost part of the bunch of recording media 9 on the sheet receive 61 contacts with the carrying roller 11 (FIG. 1). As a result, the sheet receive 61 is inclined at an angle according to the stacked amount of recording media 9 in the medium containing part 60.

Every time the image forming apparatus 1 performs an image forming operation, the sheet receive driving part 54 drives the sheet receive 61 in the same manner. Therefore, by repeatedly performing the image forming operation, the inclination angle of the sheet receive 61 increases as the stacked amount of recording media 9 in the medium containing part 60 decreases.

Figure 9:
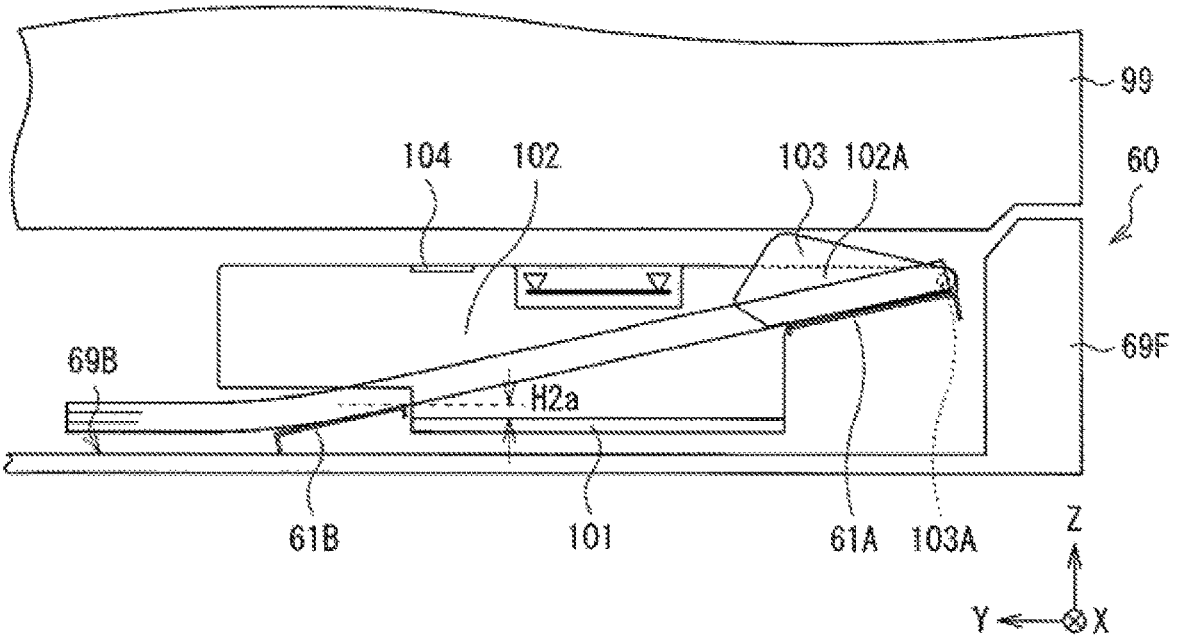
FIG. 9 is another explanatory diagram showing the actions of the medium containing part of the first embodiment.

FIG. 9 shows the state of the medium containing part 60 when the stacked amount of recording media 9 is small. In the image forming apparatus 1, by repeatedly performing the image forming operation, the stacked amount of recording media 9 decreases, and the inclination angle of the sheet receive 61 increases. Thereby, in the medium containing part 60, as shown in FIG. 9, according to the inclination angle of its sheet receive 61, the stacking part 61A of the sheet receive 61 pushes up the lower edges of the guiding parts 103. Because the guiding parts 103 can rotate centering on the rotational fulcrums 103A installed on the extension parts 102A of the guiding parts 102, the sheet receive 61 can be inclined without being blocked by these guiding parts 103.

Also, as shown in FIG. 9, as the inclination angle of the sheet receive 61 increases, the height position of the upper face of the stacking part 61B in the region adjacent to the base parts 101 becomes higher than the height position of the upper faces of the base parts 101 in the region adjacent to the stacking part 61B. In FIG. 9, this height position difference is indicated as height H2*a*. Thereby, for example, recording media 9 contained in the medium containing part 60 are held by the sheet receive 61 and not lifted up by the edge parts of the base parts 101 adjacent to the stacking part 61B, therefore deformations of the recording media 9 can be suppressed. Also, for example, when the last sheet of the recording media 9 contained in the medium containing part 60 is carried from the medium containing part 60, because the recording medium 9 does not touch the edge parts of the base parts 101, the possibility that the recording medium 9 is rubbed by touching these edge parts of the base parts 101 can be reduced. Note that this height H2*a* can vary depending on the stacked amount of recording media 9. Therefore, the stacked amount that makes this height H2*a* no smaller than 0 (zero) when the recording media 9 are contained in the medium containing part 60 can be set as the maximum stacked amount of recording media 9 for the medium containing part 60. Thereby, for example, deformations of the recording media 9 contained in the medium containing part 60 can be suppressed.

In this manner, in the image forming apparatus 1, as shown in FIG. 6, when the sheet receive 61 is in the standard position, the height position of the upper faces of the base parts 101 in the region adjacent to the stacking part 61A is set lower than the height position of the upper face of the stacking part 61A in the region adjacent to the base parts 101. Thereby, in the image forming apparatus 1, when the user slip-inserts a bunch of recording media 9 to the medium containing part 60 for example, as shown in FIG. 7, the possibility that the leading edge of the lower face of the bunch of recording media 9 is caught in the vicinity of the boundary between the stacking part 61A and the base parts 101 can be reduced. Therefore, setting the recording media 9 into the medium containing part 60 can be facilitated.

Also, in the image forming apparatus 1, as shown in FIG. 6, when the sheet receive 61 is in the standard position, the height position of the upper face of the stacking part 61B in the region adjacent to the base parts 101 is set lower than the height position of the upper faces of the base parts 101 in the region adjacent to the stacking part 61B. Thereby, in the image forming apparatus 1, when the user slip-inserts a bunch of recording media 9 to the medium containing part 60 for example, as shown in FIG. 8, the possibility that the leading edge of the lower face of the bunch of recording media 9 is caught in the vicinity of the boundary between the base parts 101 and the stacking part 61B can be reduced. Therefore, setting the recording media 9 into the medium containing part 60 can be facilitated.

Also, the image forming apparatus 1 is designed so as to install the guiding parts 103 that can rotate centering on the rotational fulcrums 103A installed on the extension parts 102A of the guiding parts 102. Thereby, in the image forming apparatus 1, when the sheet receive 61 is in the standard position, the guiding parts 103 can cover the cut-out sections below the extension parts 102A of the guiding parts 102. Therefore, for example, when the user slip-inserts a bunch of recording media 9 to the medium containing part 60, as shown in FIG. 7, the possibility that the leading edge corner of the bunch of recording media 9 is caught by the cut-out sections of the guiding parts 102 can be reduced. Therefore, setting the recording media 9 into the medium containing part 60 can be facilitated.

Also, because the guiding parts 103 can rotate centering on the rotational fulcrums 103A in this manner, the sheet receive 61 can be inclined without being blocked by these guiding parts 103. Therefore, even when the stacked amount of recording media 9 has become small, the recording media 9 can be supplied to the carrying route 10.

Also, because the image forming apparatus 1 can make it easy for the user to slip-insert a bunch of recording media 9 to the medium containing part 60 in this manner, even when the medium containing part 60 can only be extracted midway from the chassis 99 of the image forming apparatus 1, setting the recording media 9 into the medium containing part 60 can be facilitated. In other words, even when the installation space for the image forming apparatus 1 cannot be secured enough, setting the recording media 9 into the medium containing part 60 can be facilitated.

Also, in the image forming apparatus 1, for example, even when the medium containing part 60 can be fully extracted from the chassis 99, the possibility that the user damages recording media 9 by slip-inserting a bunch of the recording media 9 to the medium containing part 60. That is, when the medium containing part 60 is fully extracted from the chassis 99, the user can set a bunch of recording media 9 from right above the extracted medium containing part 60. However, in this case, because the recording media 9 interfere with the protruding parts 104 installed on the upper parts of the guiding parts 102 of the medium guides 63L and 63R (FIG. 5), the recording media 9 may be damaged. On the other hand, in the image forming apparatus 1, because the user can slip-insert a bunch of recording media 9 to the medium containing part 60, the possibility that the recording media 9 interfere with these protruding parts 104 can be reduced. As a result, the image forming apparatus 1 can reduce the possibility that recording media 9 are damaged when the user sets the recording media 9 into the medium containing part 60.

[Efficacy]

As stated above, in this embodiment, when the sheet receive is in the standard position, the height position of the upper faces of the base parts 101 in the region adjacent to the stacking part 61A is set lower than the height position of the upper face of the stacking part 61A in the region adjacent to the base parts 101, therefore setting recording media into the medium containing part can be facilitated.

In this embodiment, when the sheet receive is in the standard position, the height position of the upper face of the stacking part 61B in the region adjacent to the base parts 101 is set lower than the height position of the upper faces of the base parts 101 in the region adjacent to the stacking part 61B, therefore setting recording media into the medium containing pat can be facilitated.

In this embodiment, installed are the guiding parts 103 that can rotate centering on the rotational fulcrums installed on the extension parts of the guiding parts 102, therefor setting recording media into the medium containing part can be facilitated.

MODIFICATION EXAMPLE 1

Although in the above-mentioned embodiment, the sheet receive 61 is inclined by the sheet receive driving part 54, this invention is not limited to this, but instead, the sheet receive 61 can be inclined using a bias force by a spring for example. In this case, this spring corresponds to a specific example of the "lifting part" in this invention.

2. Second Embodiment

Next, explained is an image forming apparatus 2 of the second embodiment. This embodiment is different from the above-mentioned first embodiment in the configurations of the sheet receive and the medium guides. Note that the components that are essentially identical to those of the image forming apparatus 1 of the above-mentioned first embodiment are given the same codes, and their explanations are omitted as appropriate.

The image forming apparatus 2 is provided with a medium containing part 70 as shown in FIG. 1. In the same manner as the medium containing part 60 of the above-mentioned first embodiment (FIG. 4), the medium containing part 70 has a sheet receive 71 and two medium guides 73 (medium guides 73L and 73R).

Figure 10:
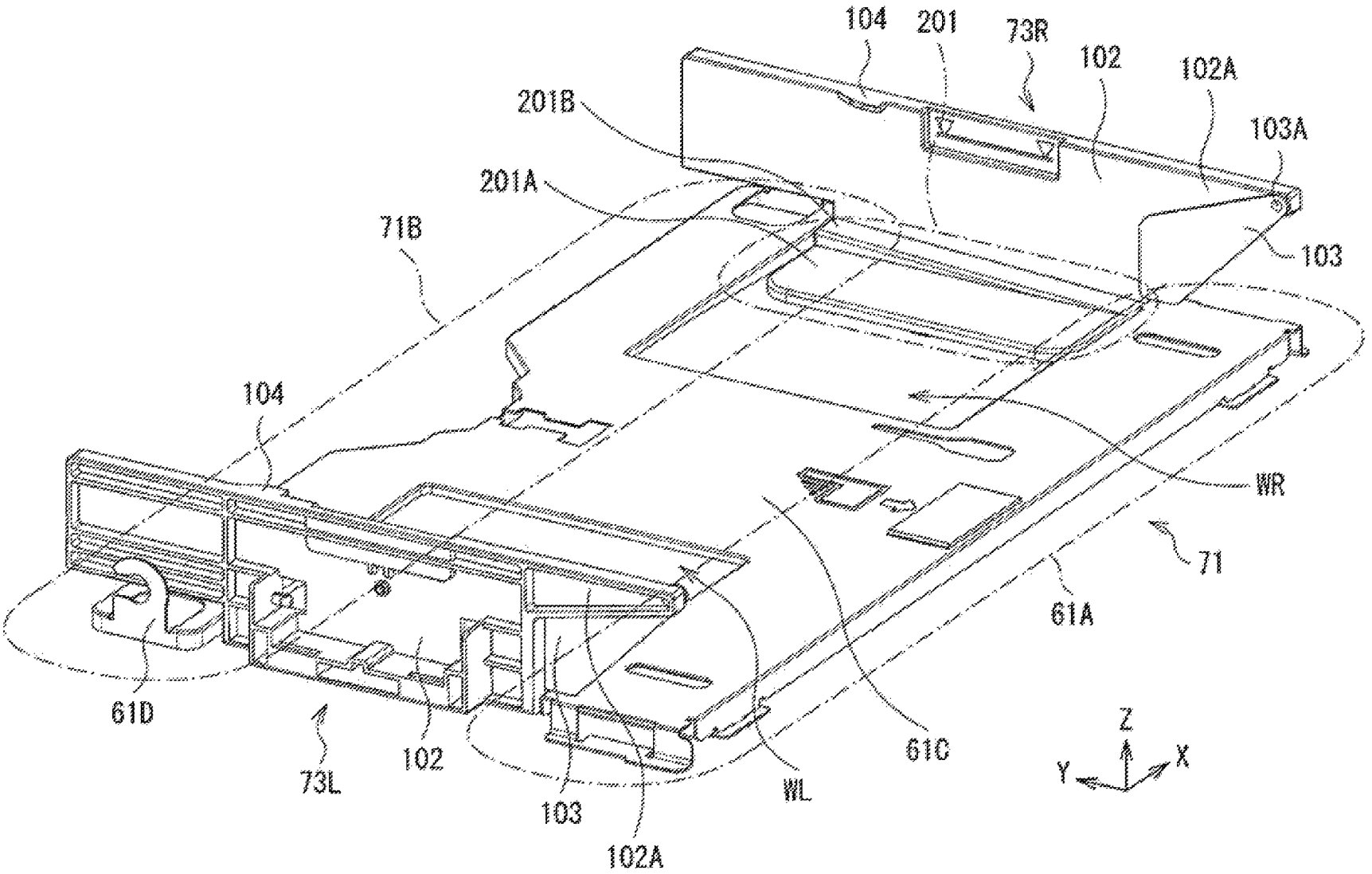
FIG. 10 is a perspective view showing a configuration example of a sheet receive and a medium guide of the second embodiment.
Figure 11:
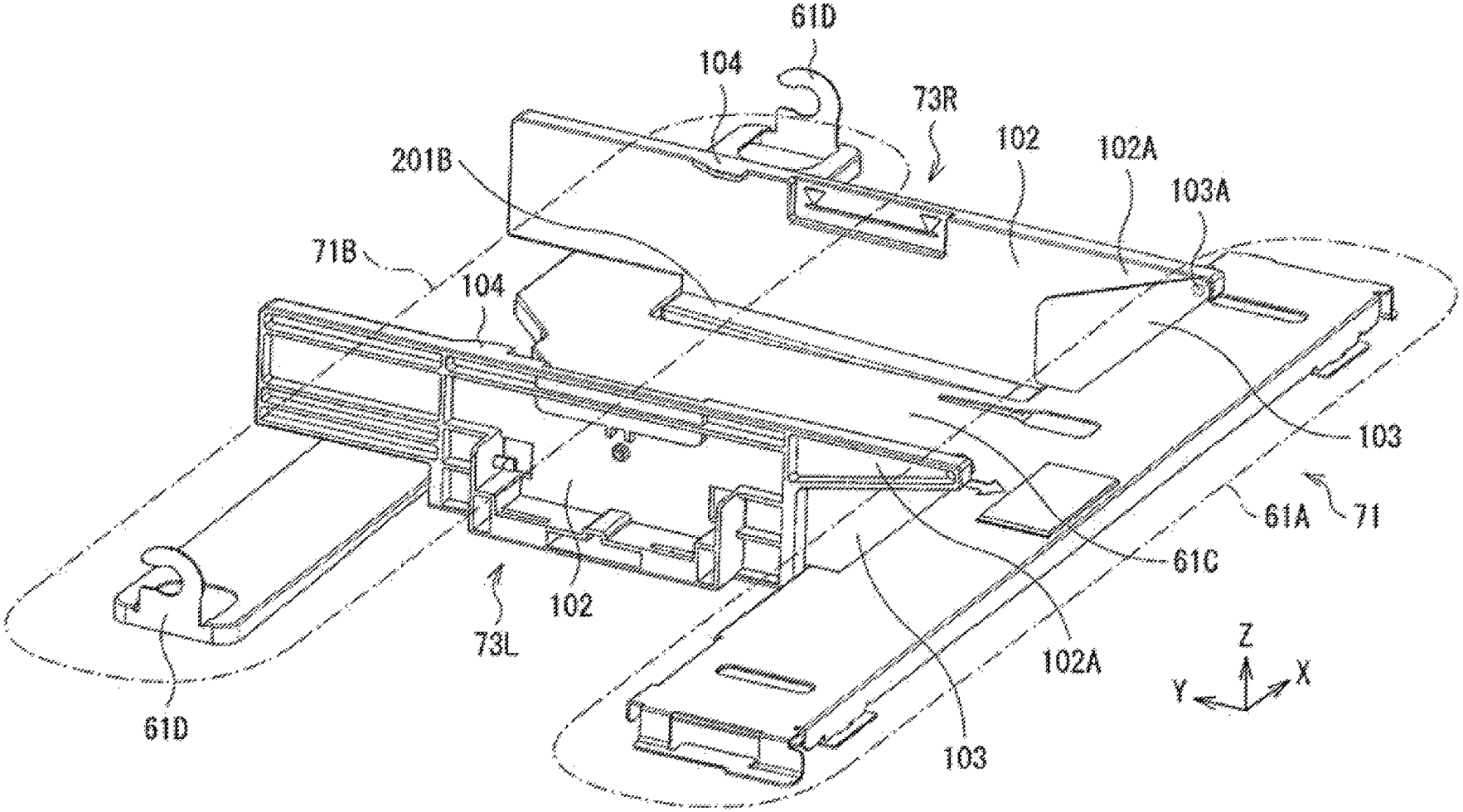
FIG. 11 is another perspective view showing a configuration example of the sheet receive and the medium guide shown in FIG. 10.

FIG. 10 shows a configuration example of the sheet receive 71 and the two medium guides 73. FIG. 11 shows the positional relation between the sheet receive 71 and the two medium guides 73 when the two medium guides 73 are moved in the X direction to narrow the space between the two medium guides 73.

The sheet receive 71 has stacking parts 61A, 71B, and 61C, and two hook-shaped parts 61D. The stacking parts 61A and 71B are formed so as to extend in the X direction and be arranged in the Y direction. The stacking part 61C connects the vicinity of the center in the X direction of the stacking part 61A and the vicinity of the center in the X direction of the stacking part 71B with each other. The upper faces of the stacking parts 61A, 71B, and 61C are formed so as to be approximately flat.

Each of the two medium guides 73 has a base part 201, guiding parts 102 and 103, and a protruding part 104. The base part 201 is configured so as to support the guiding part 102. The base part 201 has a flat part 201A and an inclined part 201B. The flat part 201A is a part away from the guiding part 102, and the upper face of the flat part 201A is configured so as to be flat in the Y direction. The inclined part 201B is a part adjacent to the guiding part 102, and the upper face of the inclined part 201B is configured so as to be inclined in the Y direction. Specifically, the height position of the upper face of the inclined part 201B decreases toward the stacking part 61A and increases toward the stacking part 71B.

As shown in FIG. 11, when the space between the two medium guides 73 is narrowed, the flat parts 201A of the base parts 201 of the two medium guides 73 fits under the stacking part 61C. On the other hand, because the inclined parts 201B of the base parts 201 of the two medium guides 73 interfere with this stacking part 61C, they are designed so as not to fit under the stacking part 61C.

Figure 12:
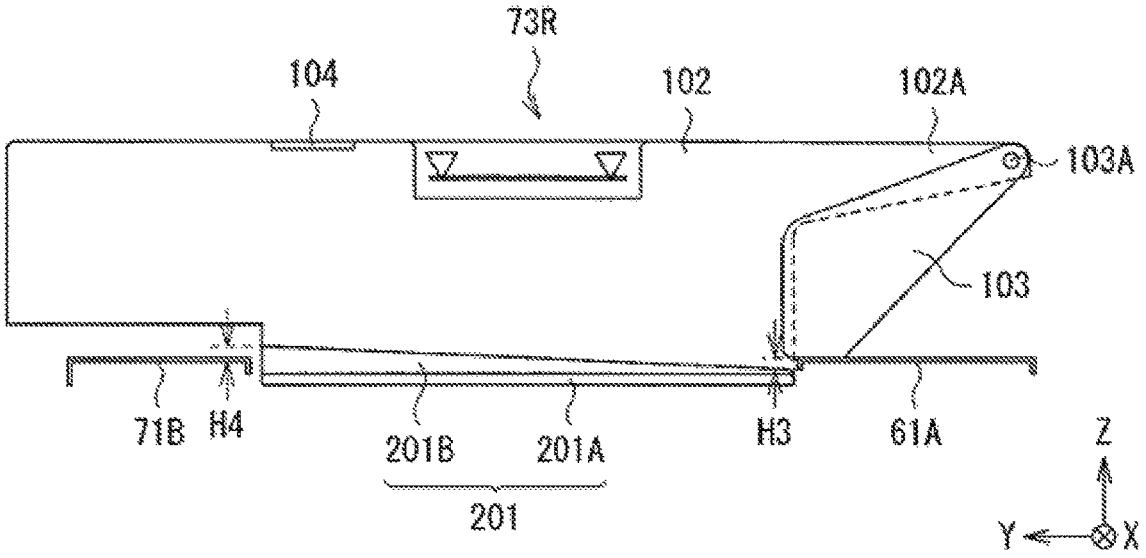
FIG. 12 is an explanatory diagram showing the positional relation between the sheet receive and the medium guide shown in FIG. 11.

FIG. 12 shows the positional relation between the medium guide 73R and the stacking parts 61A and 71B of the sheet receive 71 when the sheet receive 71 is in the standard position. As shown in this FIG. 12, the height position of the upper face of the inclined part 201B of the base part 201 in the region adjacent to the stacking part 61A is lower than the height position of the upper face of the stacking part 61A in the region adjacent to this inclined part 201B by height H3. Also, the height position of the upper face of the stacking part 71B in the region adjacent to this inclined part 201B is lower than the height position of the upper face of this inclined part 201B in the region adjacent to the stacking part 71B by height H4. Note that although in this FIG. 12 the positional relation between the medium guide 73R and the stacking parts 61A and 71B was described, the same applies to the positional relation between the medium guide 73L and the stacking parts 61A and 71B.

Figure 13:
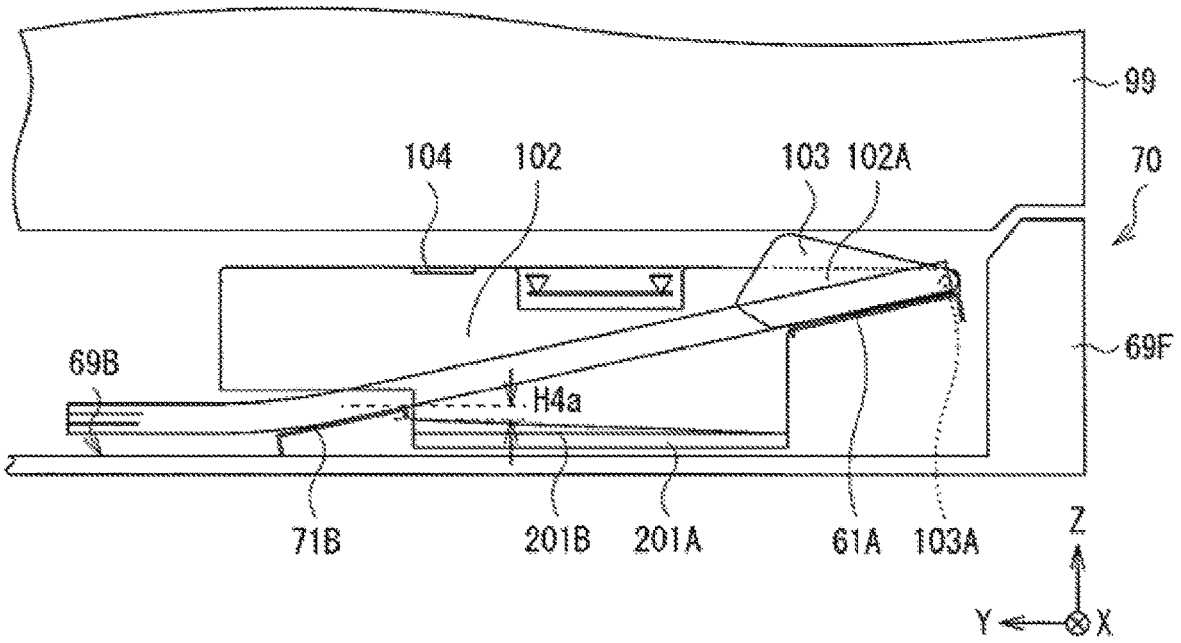
FIG. 13 is an explanatory diagram showing the actions of a medium containing part of the second embodiment.

FIG. 13 shows the state of the medium containing part 70 when the stacked amount of recording media 9 is small. As shown in FIG. 13, when the inclination angle of the sheet receive 71 becomes large, the height position of the upper face of the stacking part 71B in the region adjacent to the inclined parts 201B becomes higher than the height position of the upper faces of these inclined parts 201B in the region adjacent to the stacking part 71B. In FIG. 13, this height position difference is indicated as height H4*a*. Thereby, for example, the recording media 9 contained in the medium containing part 70 are held by the sheet receive 71 and not lifted by the edge parts of the inclined parts 201B adjacent to the stacking part 71B, therefore deformations of the recording media 9 can be suppressed. Also, for example, when the last sheet of recording media 9 contained in the medium containing part 70 is carried from the medium containing part 70, because the recording medium 9 does not touch the edge parts of the inclined parts 201B, the possibility that the edge parts of these inclined parts 201B influence the recording medium 9 can be reduced. Note that this height H4*a* can vary depending on the stacked amount of recording media 9. Therefore, when the recording media 9 are contained in the medium containing part 70, the stacked amount that makes this height H4*a* no smaller than 0 (zero) can be regarded as the maximum stacked amount of recording media 9 in the medium containing part 70. Thereby, for example, deformations of the recording media 9 contained in the medium containing part 70 can be suppressed.

In this manner, in the image forming apparatus 2, when the sheet receive 71 is in the standard position, the height position of the upper faces of the inclined parts 201B of the base parts 201 in the region adjacent to the stacking part 61A is set lower than the height position of the upper face of the stacking part 61A in the region adjacent to these inclined parts 201B. Thereby, in the same manner as in the above-mentioned first embodiment (FIG. 7), in the image forming apparatus 2, when the user slip-inserts a bunch of recording media 9 to the medium containing part 70 for example, the possibility that the leading edge of the lower face of the bunch of recording media 9 is caught in the vicinity of the boundary between the stacking part 61A and the base parts 201 can be reduced. Therefore, setting the recording media 9 into the medium containing part 70 can be facilitated.

Also, in the image forming apparatus 2, when the sheet receive 71 is in the standard position, the height position of the upper face of the stacking part 71B in the region adjacent to the inclined parts 201B of the base parts 201 is set lower than the height position of the upper faces of these inclined parts 201B in the region adjacent to the stacking part 71B. Thereby, in the same manner as in the above-mentioned first embodiment (FIG. 8), in the image forming apparatus 2, when the user slip-inserts a bunch of recording media 9 to the medium containing part 70 for example, the possibility that the leading edge of the lower face of the bunch of recording media 9 is caught in the vicinity of the boundary between the base parts 201 and the stacking part 71B can be reduced. Therefore, setting the recording media 9 into the medium containing part 70 can be facilitated.

As stated above, in this embodiment, when the sheet receive is in the standard position, the height position of the upper faces of the inclined parts of the base parts 201 in the region adjacent to the stacking part 61A is set lower than the height position of the upper face of the stacking part 61A in the region adjacent to these inclined parts. Therefore, setting the recording media into the medium continuing part can be facilitated.

In this embodiment, when the sheet receive is in the standard position, the height position of the upper face of the stacking part 71B in the region adjacent to the inclined parts of the base parts 201 is set lower than the height position of the upper faces of these inclined parts in the region adjacent to the stacking part 71B. Therefore, setting the recording media into the medium containing part can be facilitated.

Although this technology was explained above citing several embodiments and modification examples, this technology is not limited to these embodiments etc., but various modifications are possible.

For example, although in the above-mentioned embodiments etc., the base parts of the medium guides were designed not to overlap with the stacking part 61A of the sheet receive, this technology is not limited to this, but instead, part of the base parts can be disposed under the stacking part 61A for example.

For example, although in the above-mentioned embodiments etc., images were formed on recording media 9 by an electrophotographic system, this technology is not limited to this but can form images by any system. Also, although in the above-mentioned embodiments, color images were formed on the recording media 9, this technology is not limited to this but can form monochrome images.

For example, although in the above-mentioned embodiments etc., this technology was applied to single-function printers, this technology is not limited to this, but instead, it can be applied to so-called multifunction peripherals (MFPs) that have a copy function, a facsimile function, a scanning function, a printing function, etc. for example.

What is claimed is:

1. A medium containing device, comprising:

a supporting member that is composed with a first part, a second part extending in a first direction and arranged in a second direction intersecting with the first direction, and a third part connecting the first part and the second part with each other, wherein the supporting member is configured to cause the first part to incline by being lifted up from a standard position, and supports recording media, and a first guiding member that has a first base part including a part installed between the first part and the second part, and a first erected part erected on the first base part, and guides the recording media, wherein when the supporting member is in the standard position, a first height position of an upper face of the first base part in a region adjacent to the first part is lower than a second height position of an upper face of the first part in a region adjacent to the first base part, and a third height position of an upper face of the second part in a region adjacent to the first base part is lower than a fourth height position of an upper face of the first base part in a region adjacent to the second part.

2. The medium containing device according to claim 1, wherein the first height position is a height position of the upper face of the first base part in a region further adjacent to the first erected part, and the fourth height position is a height position of the upper face of the first base part in a region further adjacent to the first erected part.

3. The medium containing device according to claim 1, wherein the fourth height position is higher than the first height position.

4. The medium containing device according to claim 1, further comprising:

a medium case in which the supporting member and the first guiding member installed, and is configured to slide along a chassis to be inserted into the chassis, and a lifting part that inclines the supporting member by lifting up the first part when the medium case is set into the chassis.

5. The medium containing device according to claim 1, wherein the first guiding member is configured to move in the first direction.

6. The medium containing device according to claim 1, wherein the first erected part of the first guiding member further has an extension part at an upper region of the first part, the extension part extending in the second direction, and the first guiding member further has a rotating part that rotates centering on a rotational fulcrum installed on the extension part of the first erected part and guides the recording media.

7. The medium containing device according to claim 1, further comprising:

a second guiding member that is disposed opposing the first guiding member across the third part, the second guiding member having a second base part including a part installed between the first part and the second part, and a second erected part erected on the second base part, and guides the recording media.

8. An image forming apparatus, comprising:

a medium containing part that contains recording media, a carrying part that carries the recording media contained in the medium containing part, and image forming parts that form images on the recording media carried by the carrying part, wherein the medium containing part has a supporting member that is composed with a first part, a second part extending in a first direction and arranged in a second direction intersecting with the first direction, and a third part connecting the first part and the second part with each other, wherein the supporting member is configured to cause the first part to incline by being lifted up from a standard position, and supports recording media, and a first guiding member that has a first base part including a part installed between the first part and the second part, and a first erected part erected on the first base part, and guides the recording media, and when the supporting member is in the standard position, a first height position of an upper face of the first base part in a region adjacent to the first part is lower than a second height position of an upper face of the first part in a region adjacent to the first base part, and a third height position of an upper face of the second part in a region adjacent to the first base part is lower than a fourth height position of an upper face of the first base part in a region adjacent to the second part.

* * * * *